US009695614B2

(12) United States Patent
Jeong

(10) Patent No.: US 9,695,614 B2
(45) Date of Patent: Jul. 4, 2017

(54) DOOR OUTSIDE HANDLE

(71) Applicant: Hyundai Motor Company, Seoul (KR)

(72) Inventor: Ki Hwan Jeong, Seoul (KR)

(73) Assignee: Hyundai Motor Company, Seoul (KR)

( * ) Notice: Subject to any disclaimer, the term of this patent is extended or adjusted under 35 U.S.C. 154(b) by 51 days.

(21) Appl. No.: 14/290,707

(22) Filed: May 29, 2014

(65) Prior Publication Data

US 2015/0176305 A1 Jun. 25, 2015

(30) Foreign Application Priority Data

Dec. 19, 2013 (KR) ..... 10-2013-0159677

(51) Int. Cl.

| | |
|---|---|
| ***E05B 3/00*** | (2006.01) |
| ***E05B 1/00*** | (2006.01) |
| ***E05B 83/40*** | (2014.01) |
| ***E05B 85/10*** | (2014.01) |
| ***E05C 17/60*** | (2006.01) |
| ***E05B 13/00*** | (2006.01) |

(52) U.S. Cl.

CPC ..... *E05B 1/0038* (2013.01); *E05B 13/002* (2013.01); *E05B 83/40* (2013.01); *E05B 85/10* (2013.01); *E05C 17/60* (2013.01); *E05B 2001/0076* (2013.01); *Y10T 292/57* (2015.04)

(58) Field of Classification Search

CPC ... Y10T 292/57; E05B 1/0036; E05B 13/002; E05B 83/40; E05B 85/10; E05B 17/60; E05B 2001/0076; E05B 77/06; E05B 77/04; E05B 77/02; E05B 13/00; E05B 85/16; Y10S 292/41; E05C 19/18; E05C 1/085; E05C 1/10

USPC ..... 292/336.3, DIG. 65, DIG. 22, DIG. 30, 292/DIG. 31; 16/110.1, 412

See application file for complete search history.

(56) References Cited

U.S. PATENT DOCUMENTS

| | | | | | |
|---|---|---|---|---|---|
| 3,153,552 | A | * | 10/1964 | Sandor | E05B 85/14 292/336.3 |
| 3,153,553 | A | * | 10/1964 | Sandor | E05B 85/14 292/336.3 |
| 3,159,415 | A | * | 12/1964 | Sandor | E05B 85/16 292/336.3 |
| 3,719,248 | A | * | 3/1973 | Breitschwerdt | E05B 77/06 180/271 |
| 3,967,844 | A | * | 7/1976 | Torii | E05B 85/18 292/210 |
| 4,475,754 | A | * | 10/1984 | Arlauskas | E05B 85/16 292/336.3 |

(Continued)

FOREIGN PATENT DOCUMENTS

| | | |
|---|---|---|
| JP | 2005-264525 A | 9/2005 |
| JP | 2007-085032 A | 4/2007 |

(Continued)

*Primary Examiner* — Kristina Fulton
*Assistant Examiner* — Faria Ahmad
(74) *Attorney, Agent, or Firm* — Morgan Lewis & Bockius LLP

(57) ABSTRACT

A door outside handle mounted on a sliding door may include a grip assembly that slides to a front of a vehicle and unlocks a hold-open lock of the sliding door while sliding forward, and a blocking link that prevents the grip assembly from sliding forward by moving ahead of the grip assembly when a door latch is locked with closing of the sliding door.

9 Claims, 3 Drawing Sheets

(56) References Cited

U.S. PATENT DOCUMENTS 5,015,020 A * 5/1991 Mizuki ..... E05B 85/243 292/216
5,092,642 A * 3/1992 Lindmayer ..... E05B 77/42 292/201
5,123,687 A * 6/1992 Pfeiffer ..... E05B 1/0092 292/336.3
5,860,684 A * 1/1999 Mizuki ..... E05B 83/36 292/336.3
5,887,918 A * 3/1999 Okada ..... E05B 85/10 292/141
6,007,122 A * 12/1999 Linder ..... E05B 85/10 292/216
6,062,615 A * 5/2000 Hunt ..... E05B 85/12 292/216
6,067,869 A * 5/2000 Chilla ..... E05B 77/04 292/336.3
6,264,257 B1 * 7/2001 Meinke ..... E05B 85/10 292/336.3
6,382,688 B1 * 5/2002 Agostini ..... E05B 77/06 292/336.3
6,447,030 B1 * 9/2002 Meinke ..... E05B 77/06 292/336.3
6,565,134 B1 * 5/2003 Stuart ..... E05B 77/06 292/336.3
6,575,508 B2 * 6/2003 Stuart ..... E05B 77/06 292/336.3
6,588,813 B1 * 7/2003 Marcarini ..... E05B 85/16 292/336.3
6,598,912 B2 * 7/2003 Hillgaertner ..... E05B 13/005 292/225
6,709,033 B2 * 3/2004 Jooss ..... E05B 77/06 16/412
7,070,216 B2 * 7/2006 von zur Muehlen ... E05B 77/06 292/336.3
7,111,880 B2 * 9/2006 Saitoh ..... E05B 77/04 292/336.3
7,677,614 B2 * 3/2010 Monig ..... E05B 85/16 292/336.3
8,146,393 B2 * 4/2012 Katagiri ..... E05B 17/18 292/336.3
8,152,209 B2 * 4/2012 Lee ..... E05B 77/06 292/336.3
8,167,342 B2 * 5/2012 Bertolotti ..... E05B 77/06 292/336.3
8,322,077 B2 * 12/2012 Papanikolaou ..... 292/336.3
8,366,159 B2 * 2/2013 Patel ..... E05B 77/06 292/203
8,424,936 B2 * 4/2013 Muller ..... E05B 77/06 292/336.3
8,690,204 B2 * 4/2014 Lang ..... E05B 81/77 292/279
8,833,812 B2 * 9/2014 Sakai ..... E05B 77/04 292/336.3
8,864,192 B2 * 10/2014 Lesueur ..... E05B 77/06 292/336.3
9,062,477 B2 * 6/2015 Da Deppo ..... E05B 77/06
9,394,729 B2 * 7/2016 Da Deppo ..... E05B 85/16
9,404,292 B2 * 8/2016 Da Deppo ..... E05B 77/06
2002/0148075 A1 * 10/2002 Monig ..... E05B 77/06 16/412
2003/0001399 A1 * 1/2003 Sato ..... E05B 79/06 292/336.3
2003/0019261 A1 * 1/2003 Wittwer ..... E05B 85/107 70/257
2004/0232710 A1 * 11/2004 Jooss ..... E05B 81/78 292/336.3
2005/0012345 A1 * 1/2005 Saitoh ..... E05B 77/04 292/336.3
2005/0161959 A1 * 7/2005 Belchine ..... E05B 77/06 292/336.3
2005/0184537 A1 * 8/2005 Le ..... E05B 77/06 292/336.3
2005/0218668 A1 * 10/2005 Sakamoto ..... E05B 77/04 292/336.3
2007/0024068 A1 * 2/2007 Wood ..... E05B 77/06 292/336.3
2007/0069532 A1 * 3/2007 Tenorio ..... E05B 77/06 292/336.3
2007/0080547 A1 * 4/2007 Lee ..... E05B 77/06 292/336.3
2007/0138812 A1 * 6/2007 Kondo ..... E05B 85/16 292/336.3
2007/0284892 A1 * 12/2007 Nozawa ..... E05B 77/265 292/216
2008/0001412 A1 * 1/2008 Nozawa ..... E05B 81/06 292/2
2008/0036219 A1 * 2/2008 Savant ..... E05B 77/06 292/336.3
2008/0277948 A1 * 11/2008 Takaya ..... E05B 85/16 292/336.3
2009/0026774 A1 * 1/2009 Watanabe ..... E05B 77/06 292/336.3
2009/0243307 A1 * 10/2009 Lee ..... E05B 77/06 292/93
2010/0071165 A1 * 3/2010 Costigan ..... E05B 85/16 16/412
2011/0115240 A1 * 5/2011 Muller ..... E05B 77/06 292/336.3
2013/0221690 A1 * 8/2013 Rocci ..... E05B 77/06 292/336.3
2014/0000167 A1 * 1/2014 Patel ..... E05B 81/34 49/32
2014/0015262 A1 * 1/2014 Da Deppo ..... E05B 77/06 292/336.3
2014/0015263 A1 * 1/2014 Da Deppo ..... E05B 85/16 292/336.3
2014/0117679 A1 * 5/2014 Ishihara ..... E05B 79/20 292/171
2014/0159391 A1 * 6/2014 Jeong ..... E05B 85/10 292/336.3
2014/0246868 A1 * 9/2014 Corwin ..... E05B 77/04 292/7
2014/0292005 A1 * 10/2014 Bendel ..... E05B 77/06 292/336.3
2015/0054295 A1 * 2/2015 Nam ..... E05B 1/003 292/336.3
2015/0069767 A1 * 3/2015 Nam ..... E05B 77/06 292/336.3
2015/0167361 A1 * 6/2015 Park ..... E05B 85/16 292/336.3
2015/0167362 A1 * 6/2015 Kang ..... E05B 85/16 292/336.3
2015/0184431 A1 * 7/2015 Da Deppo ..... E05B 85/10 292/336.3

FOREIGN PATENT DOCUMENTS

JP 2013-076217 A 4/2013
JP 2013076219 A 4/2013
KR 100821006 B1 4/2008
KR 1020100002626 A 1/2010
KR 10-2012-0000913 A 1/2012
KR 1020120046650 A 5/2012

* cited by examiner

DOOR OUTSIDE HANDLE

CROSS-REFERENCE TO RELATED APPLICATION

The present application claims priority of Korean Patent Application Number 10-2013-0159677 filed on Dec. 19, 2013, the entire contents of which application are incorporated herein for all purposes by this reference.

BACKGROUND OF INVENTION

Field of Invention

The present invention relates to a door outside handle, and more particularly, to a door outside handle that can slide forward with a sliding door open, but not move forward with the sliding door closed.

Description of Related Art

Sliding doors of vehicles are moved to the rear of the vehicles on a rail formed along the outer side of the vehicles, when they are opened. The doors are equipped with a hold-open lock to be prevented from sliding forward regardless of passenger's intention when they are open, and they are equipped with a door latch too, which is locked to the car body, to be prevented from sliding rearward when they are closed.

Since the door latch and hold-open lock are made to be automatically operated when the doors are fully open or completely closed, a door outside handle is provided on the outer side of the doors to unlock them. The door outside handle is connected with the door latch and the hold-open lock to selectively unlock them, when it is pulled by a passenger.

On the other hand, since the sliding doors slide to the front or the rear of vehicles, the door outside handle has a structure for a passenger to easily unlock and slide them forward/rearward. To this end, recently, bidirectional door outside handles that make it possible to unlock a door latch when they are pulled and to unlock a hold-open lock when a sliding door slides forward have been proposed. Accordingly, a passenger can smoothly open a sliding door that is closed by pulling the door outside handle and moving the door rearward and can easily close a sliding door that is fully open by sliding the door outside handle forward and moving the door forward.

For reference, in KR10-2012-0046650A titled "outside handle for vehicle with sliding door mounted", a structure that has a handle grip, which can slide forward/rearward and can be pulled outward, and is unlocked by being pulled has been proposed in the related art.

However, even in this configuration of the related art, it is impossible to prevent the door outside handle from sliding forward with a door locked, so passengers try not pulling the door outside handle outward, but sliding it forward in order to open a closed door by misunderstanding how to unlock the door; therefore, it is not easy to find how to open a door.

On the other hand, in the related art, a door latch that unlocks a closed door when a door outside handle is pulled is disclosed in KR10-2010-0002626A titled "door latch apparatus for vehicles" and a hold-open lock that is unlocked when a door inside handle is pulled with a sliding door fully open is disclosed in KR10-0821006 B1 titled "sliding door hold open lock apparatus of automobile".

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a door outside handle with a stopper that is inserted into the movement path of the door outside handle when a door is closed, in order to prevent the door outside handle from further moving forward with the door closed.

Various aspects of the present invention provides a door outside handle that is mounted on a sliding door and may include a grip assembly that slides to a front of a vehicle and unlocks a hold-open lock of the sliding door while sliding forward, and a blocking link that prevents the grip assembly from sliding forward by moving ahead of the grip assembly when a door latch is locked with closing of the sliding door. The grip assembly may unlock the door latch that is locked, when pulled in cooperation of the door latch.

The door outside handle may further include a link assembly having one end that is connected to the grip assembly to move with forward/rearward movement of the grip assembly and the other end that comes in contact with the blocking link to stop the grip assembly from moving when the door latch is locked.

The link assembly may include a support shaft with a front end and a rear end supported to be movable forward/rearward in the door, a contact link fixed between the front end and the rear end of the support shaft, with an upper end connected with the grip assembly and a lower end in contact with the blocking link, and an elastic member fixed to the door, ahead of the contact rink, and pressing back the contact link.

One end of the blocking link may be coupled to the door by a hinge pin so that the blocking link rotates substantially vertically under the link assembly, and the other end of the blocking link may be positioned ahead of the contact link when the blocking link rotates upward. A torsion spring applying a rotational force upward to the blocking link may be disposed on the hinge pin.

A connecting link that is capable of moving up/down when the door latch is locked, with an upper end coupled to the other end of the blocking link and an lower end coupled to the door latch, may be disposed between the other end of the blocking link and the door latch.

The other end of the blocking link may be formed in a shape of an arc, in which a top of the other end of the blocking link may be in contact with the contact link and a slot may be formed along the arc at a bottom of the other end of the blocking link, wherein when the door latch is unlocked, one end of the connecting link may be in contact with a lower end of the slot, thereby preventing upward movement of the blocking link, and when the door latch is locked, the one end of the connecting link may be separated from the lower end of the slot, thereby allowing the blocking link to rotate.

The hinge pin may be coupled to the blocking link such that a longitudinal direction is a front-rear direction of the vehicle and the other end of the blocking link may face the inside of the vehicle. The rear end of the support shaft and an open holder lock may be connected by a wire, so that when the support shaft moves forward, the wire may be pulled and the open holder lock may be unlocked. A cam that rotates upward when the door latch is locked may be disposed in the door latch and the lower end of the connecting link may be rotatably coupled to an end of the cam.

The support shaft may be a rotary shaft, the upper end of the contact link may rotate outside the door when the grip assembly is pulled, and the door latch may have a latch wire of which one end is connected with the upper end of the contact link, so that the door latch may be unlocked when the latch wire is pulled.

According to the door outside handle of the present invention, since the door outside handle cannot move forward with a door closed, it is possible to make a passenger not confuse how to open the door, so the merchantability of the vehicle is improved.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other features of the present invention will now be described in detail with reference to certain exemplary embodiments thereof illustrating the accompanying drawings which are given herein below by way of illustration only, and thus are not limitative of the present invention, and wherein.

Figure 1A:
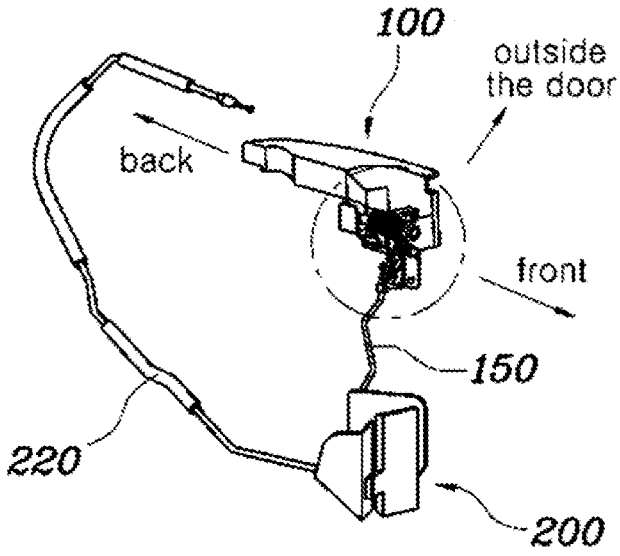
FIG. 1A is a view showing the configuration of an exemplary door outside handle according to the present invention.

It should be understood that the appended drawings are not necessarily to scale, presenting a somewhat simplified representation of various preferred features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1B:
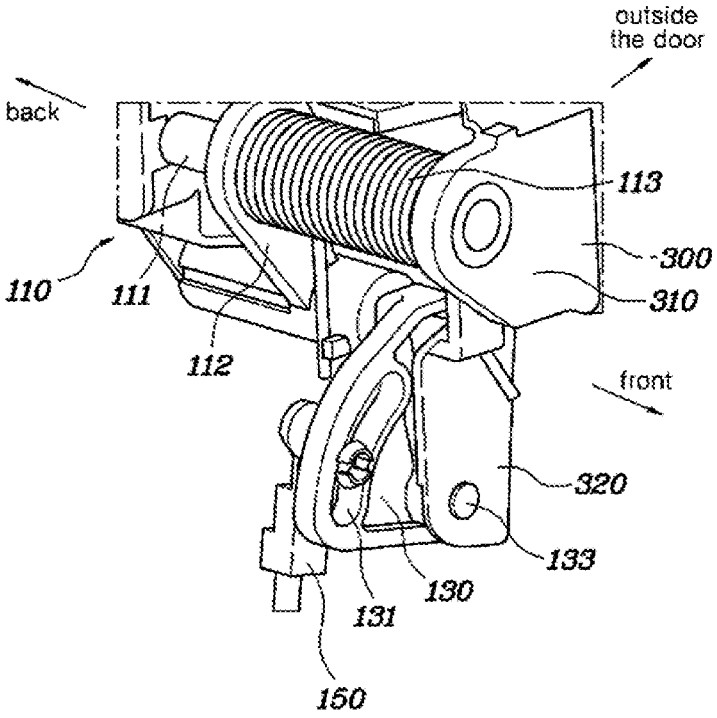
FIG. 1B is a partially enlarged view of FIG. 1A.

FIGS. 1A and 1B illustrate a configuration of a door outside handle according to various embodiments of the present invention and the door outside handle according to various embodiments of the present invention, which may be mounted on a sliding door, includes a grip assembly 100 that slides to the front of a vehicle and unlocks a hold-open lock of a sliding door while sliding forward and a blocking link 130 that prevents the grip assembly 100 from sliding forward by moving ahead of the grip assembly 100 when a door latch 200 is locked with closing of the sliding door.

In detail, the grip assembly 100 includes a lever that a passenger can operate outside the door 300 to open/close the door 300, the front end and the rear end of the grip assembly 100 are coupled to the door 300, a hole such as an oblong hole is formed in the door 300 to which the grip assembly 100 is coupled so that the grip assembly 100 can slide, and the grip assembly 100 can slide forward along the oblong hole. Further, the rear end of the grip assembly 100 is inserted in the oblong hole and then bent rearward with respect to the door 300 or up and down with respect to the door 300 so that the rear end of the grip assembly 100 is prevented from separating from the door 300 and the grip assembly 100 can rotate about the rear end. Other than this way, the grip assembly 100 may be coupled to the door 300 in various ways. The coupling structure of the grip assembly 100 and the door 300 is the same as or similar to that of the related art.

Accordingly, since the grip assembly 100 can be pulled and slid forward outside the door 300, it unlocks a hold-open lock of the sliding door when it slides forward, and it unlocks a door latch 200 that is locked when it is pulled in cooperation of the door latch 200.

Describing the door outside handle in detail, in some embodiments, the door outside handle further includes a link assembly 110 having one end that is connected to the grip assembly or the grip 100 in the door 300 to move with forward/rearward movement of the grip assembly or the grip 100 and the other end that comes in contact with the blocking link 130 to stop it from moving when the door latch 200 is locked.

Since the link assembly 110 comes in contact with the blocking link 130 in the door 300, for example, between the outer panel and the inner panel of the door 300, the blocking link 130 does not protrude outside the door 300 to stop forward movement of the link assembly 110, so the external appearance can be made smooth.

In detail, the link assembly 110 may include a support shaft 111 with the front end and the rear end supported to be movable forward/rearward in the door 300, a contact link 112 fixed between the front end and the rear end of the support shaft 111, with the upper end connected with the front end of the grip assembly 100 and the lower end in contact with the blocking link 130, and an elastic member 113 fixed to the door 300, ahead of the contact rink 112, and pressing back or abutting the contact link 112.

The link assembly 110 is disposed at the front portion of the grip assembly 100, the support shaft 111 is a rotary shaft, the upper end of the contact link 112 rotates outside the door when the grip 100 is pulled, and the door latch 200 has a latch wire 220 of which the end is connected with the upper end of the contact link 112, so that the door latch 200 is unlocked when the latch wire 220 is pulled. The structure of the door latch 200 that is unlocked when the latch wire 220 is pulled is similar to that of the related art.

Support protrusions 310 having holes that are formed in the front-rear direction in the door, corresponding to the front end and the rear end of the support shaft 111 to fix the support shaft 111, are formed and the elastic member 113 is disposed between the support protrusion 310 coupled with the front end of the support shaft 111 and the contact link 112 and presses back the support shaft 111. Accordingly, the grip assembly 100 can be moved forward by a passenger pressing it, and it can return when pressing by the passenger is removed. The contact link 112 may be formed in the shape of a panel to ensure a sufficient area for contact with the elastic member 113.

Further, the elastic member 113 may be a coil spring and may function as a torsion spring that has both ends elongated outward, in which the rear end is supported by the lower end of the contact link 112 and the front end is supported by the door, and presses the contact link 112 to rotate the lower end of the contact link 112 outward. Accordingly, the upper end of the contact link 112 is pressed by the elastic member 113 to rotate inward the door, so the grip 100 can return after being pulled.

Figure 2:
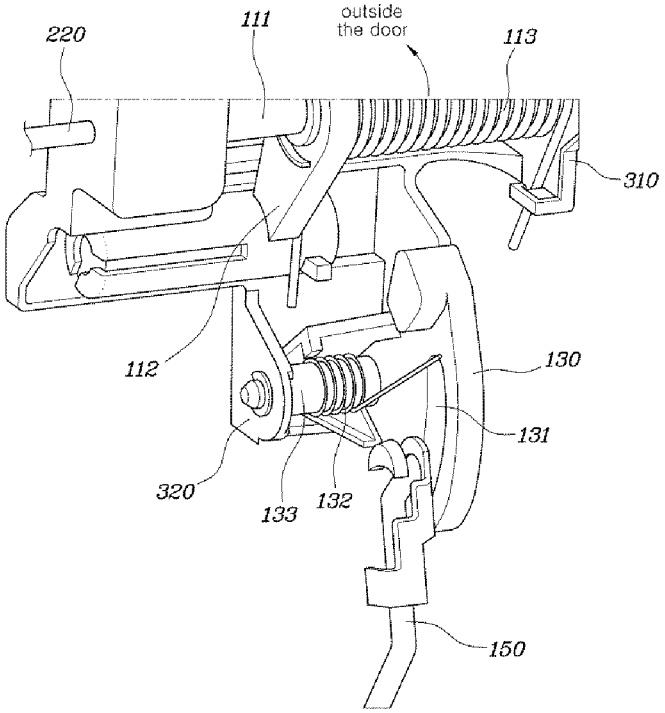
FIG. 2 is a view showing an exemplary blocking link according to the present invention when a door latch is unlocked.

On the other hand, as shown in FIG. 2, one end of the blocking link 130 may be coupled to the door 300 by a hinge pin 133 so that the blocking link 130 can rotate vertically or substantially vertically under the link assembly 110, and the other end may be positioned ahead of the contact link 112 when the blocking link 130 rotates upward. Since one end is rotatably coupled to the door 300, the weight of the blocking link 130 can be partially supported by the door 300, so a force enough to support the entire weight of the blocking link 130 is not needed when the blocking link 130 is rotated upward. Accordingly, it is possible to reduce the size of a pressing member for rotating the blocking link 130, so the space and weight of the pressing member are reduced, which can contribute to installing electric devices in the door and improving the fuel efficiency of a vehicle.

Describing the pressing member, the pressing member is a torsion spring 132 disposed on the hinge pin 133 and applying an upward rotational force to the blocking link 130, and the torsion spring enables the blocking link 130 to rapidly rotate upward.

Figure 3:
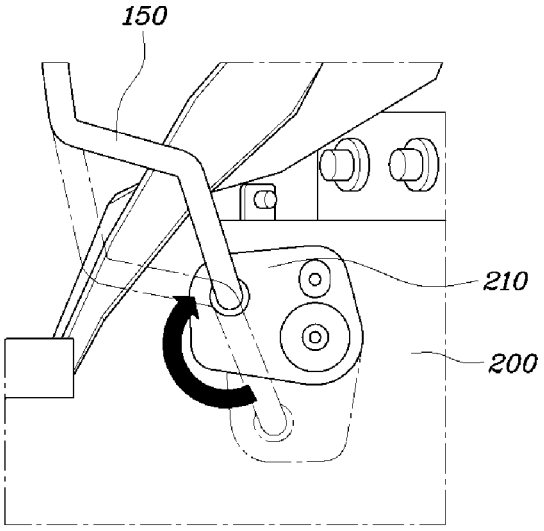
FIG. 3 is a view showing rotation of an exemplary cam according to the present invention while a door latch is locked.

A connecting link 150 that moves up/down when the door latch 200 is locked, with the upper end coupled to the other end of the blocking link 130 and the lower end coupled to the door latch 200, is disposed between the other end of the blocking link 130 and the door latch 200, and to this end, as shown in FIG. 3, a cam 210 that rotates upward when the door latch 200 is locked may be disposed in the door latch 200 and the lower end of the connecting link 150 may be rotatably coupled to the end of the cam 210.

That is, the door latch 200 unlocks the door when the latch wire 220 is pulled, as described above, in which a link connected with the latch wire 220 is rotated. The rotating link and the cam 210 are connected to rotate together. Accordingly, when the door latch 200 is unlocked, the cam 210 and the connecting link 150 rotate downward and the connecting link 150 prevents upward rotation of the blocking link 130, so the link assembly 110 can freely move forward.

Figure 4:
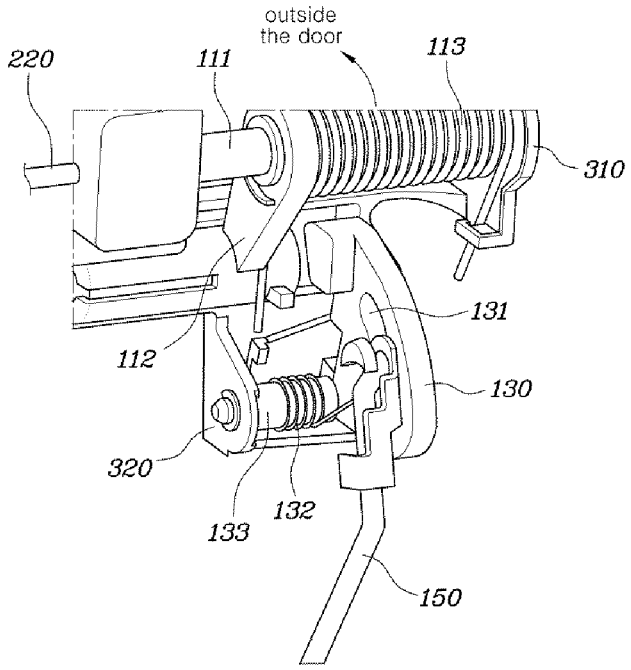
FIG. 4 is a view showing an exemplary blocking link according to the present invention when a door latch is locked.

However, when the door latch 200 is locked, the link connected with the latch wire 220 rotates in the opposite direction to the pulling direction of the latch wire 220, the cam 210 rotates upward, as shown in FIG. 3, and enables the blocking link 130 to rotate upward, as in FIG. 4. The blocking link is rotated upward by the torsion spring 132, so it prevents forward movement of the link assembly 110.

In the detailed shape of the blocking link 130, the other end of the blocking link 130 is formed in the shape of an arc, in which the top of the other end may be in contact with the contact link 112 and a slot 131 may be formed along the arc at the bottom of the other end. Accordingly, with the door latch 200 unlocked, one end of the connecting link 150 prevents upward movement of the blocking link 130, in contact with the lower end of the slot 131, and it is separated from the lower end of the slot 131 when the door latch is locked, as in FIG. 4, so the blocking link 130 can freely rotate. Therefore, the blocking link 130 is rapidly moved ahead of the lower end of the contact link 112 by the elastic member 113 and brought in contact with the lower end of the contact link 112, so it can prevent movement of the link assembly 110.

On the other hand, the hinge pin 133 may be coupled to the blocking link 130 such that the longitudinal direction is the front-rear direction of a vehicle and the other end of the blocking link 130 may be arranged to face the inside of the door 300. The blocking link 130 can be supported by the hinge pin 133 against the forward pressing force generated when the top of the other end of the blocking link 130 comes in contact with the lower end of the contact link 112. Accordingly, the blocking link 130 can resist the forward pressing force by a passenger regardless of the elastic force of the torsion spring 132 disposed on the hinge pin 133. Fixing protrusions 320 may be provided on the door 300, at positions corresponding to both ends of the hinge pin 133, to fix the hinge pin 133 to the door 300 in the front-rear direction.

On the other hand, the rear end of the support shaft 111 and the open holder lock are connected by a wire, so when the support shaft 111 moves forward, the wire is pulled and the open holder lock is unlocked. The unlocking of the open holder lock by the wire pulled is similar to that of the related art and the detailed description is not provided.

For convenience in explanation and accurate definition in the appended claims, the terms "upper" or "lower", "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door outside handle that is mounted on a sliding door, comprising:

a grip assembly slidable to a front of a vehicle;

a blocking link preventing the grip assembly from sliding forward when a door latch is locked with closing of the sliding door; and a link assembly having a first end connected to the grip assembly to selectively move with forward/rearward movement of the grip assembly and a second end selectively coming in contact with the blocking link to stop the grip assembly from moving when the door latch is locked, wherein the link assembly includes:

a support shaft movable forward/rearward; and a contact link fixed to the support shaft, wherein a first end of the blocking link is coupled to the door by a hinge pin so that the blocking link rotates substantially vertically under the link assembly, wherein a second end of the blocking link is configured to be directly contacted with the contact link when the blocking link rotates upward so as to prevent a forward movement of the link assembly, and wherein a torsion spring applying a rotational force upward to the blocking link is disposed on the hinge pin.

2. The door outside handle of claim 1, wherein the grip assembly unlocks the door latch that is locked, when pulled in cooperation of the door latch.

3. The door outside handle of claim 1, wherein the support shaft includes a front end and a rear end supported to be movable forward/rearward in the door;

wherein the contact link is fixed between the front end and the rear end of the support shaft, with an upper end connected with the grip assembly and a lower end selectively in contact with the blocking link; and wherein the link assembly further includes:

an elastic member fixed to the door, ahead of the contact link, and pressing back the contact link.

4. The door outside handle of claim 1, wherein a connecting link capable of moving up/down when the door latch is locked, with an upper end coupled to the second end of the blocking link and a lower end coupled to the door latch, is disposed between the second end of the blocking link and the door latch.

5. The door outside handle of claim 4, wherein the second end of the blocking link is formed in a shape of an arc, in which a top of the second end of the blocking link is selectively in direct contact with the contact link and a slot is formed along the arc at a bottom of the second end of the blocking link, wherein when the door latch is unlocked, a first end of the connecting link is in contact with a lower end of the slot, thereby preventing upward movement of the blocking link, and when the door latch is locked, the first end of the connecting link is separated from the lower end of the slot, thereby allowing the blocking link to rotate.

6. The door outside handle of claim 1, wherein the hinge pin is coupled to the blocking link such that a longitudinal direction is a front-rear direction of the vehicle and the second end of the blocking link faces an inside of the vehicle.

7. The door outside handle of claim 4, wherein a cam rotating upward when the door latch is locked is disposed in the door latch and the lower end of the connecting link is rotatably coupled to an end of the cam.

8. The door outside handle of claim 3, wherein the support shaft is a rotary shaft, the upper end of the contact link rotates towards the outside of the door when the grip assembly is pulled, and the door latch has a latch wire of which a first end is connected with the upper end of the contact link, so that the door latch is unlocked when the latch wire is pulled.

9. The door outside handle of claim 3, further comprising:

a connecting link disposed between the second end of the blocking link and the door latch, with an upper end coupled to the second end of the blocking link and a lower end coupled to the door latch, wherein the connecting link is capable of moving up/down when the door latch is locked.

* * * * *